US012509789B2

(12) United States Patent
Zhu et al.

(10) Patent No.: US 12,509,789 B2
(45) Date of Patent: Dec. 30, 2025

(54) SULFONATE ELECTROPLATING BATH, PROCESS FOR REFINING METAL BY ELECTROLYTIC DEPOSITING AND PROCESS FOR CONTROLLING METAL MORPHOLOGY IN ELECTROLYTIC REFINING

(71) Applicant: BASF SE, Ludwigshafen am Rhein (DE)

(72) Inventors: Si Jun Zhu, Shanghai (CN); Jin Bo Song, Shanghai (CN); Jing Cheng Xia, Shanghai (CN); Yong Ming Chen, Hunan (CN); Cong Chang, Hunan (CN); You Gang Li, Hunan (CN); Chang Liu Xiang, Hunan (CN); Sheng Hai Yang, Hunan (CN)

(73) Assignee: BASF SE, Ludwigshafen am Rhein (DE)

( * ) Notice: Subject to any disclaimer, the term of this patent is extended or adjusted under 35 U.S.C. 154(b) by 133 days.

(21) Appl. No.: 18/562,695

(22) PCT Filed: May 12, 2022

(86) PCT No.: PCT/EP2022/062881
§ 371 (c)(1),
(2) Date: Nov. 20, 2023

(87) PCT Pub. No.: WO2022/243145
PCT Pub. Date: Nov. 24, 2022

(65) Prior Publication Data

US 2024/0287696 A1 Aug. 29, 2024

(30) Foreign Application Priority Data

May 20, 2021 (WO) ..... PCT/CN2021/094819

(51) Int. Cl.
*C25D 3/32* (2006.01)
*C25D 3/36* (2006.01)

(52) U.S. Cl.
CPC ..... *C25D 3/32* (2013.01); *C25D 3/36* (2013.01)

(58) Field of Classification Search
None
See application file for complete search history.

(56) References Cited

U.S. PATENT DOCUMENTS

| | | | | |
|---|---|---|---|---|
| 4,496,439 | A * | 1/1985 | Greif | C25D 3/22 205/314 |
| 10,400,342 | B2 | 9/2019 | Imori et al. | |
| 2004/0256239 | A1 | 12/2004 | Whitlaw et al. | |
| 2018/0118671 | A1 | 5/2018 | Maitro-Vogel et al. | |
| 2019/0390357 | A1 * | 12/2019 | Tatsumi | C25D 3/60 |

FOREIGN PATENT DOCUMENTS

| | | | |
|---|---|---|---|
| CN | 100370062 | C | 2/2008 |
| CN | 104746908 | A | 7/2015 |
| CN | 112064070 | A | 12/2020 |
| EP | 3428320 | B1 | 5/2021 |
| JP | 2015036449 | A | 2/2015 |
| WO | 97/23664 | A1 | 7/1997 |
| WO | 98/23444 | A1 | 6/1998 |

OTHER PUBLICATIONS

International Search Report for PCT Patent Application No. PCT/CN2021/094819, Issued on Oct. 21, 2021, 4 pages.
International Search Report for PCT Patent Application No. PCT/EP2022/062881, Issued on Sep. 6, 2022, 4 pages.

* cited by examiner

*Primary Examiner* — Wojciech Haske
(74) *Attorney, Agent, or Firm* — ArentFox Schiff LLP

(57) ABSTRACT

The present invention relates to an electroplating bath comprising (A) an alkane sulfonic acid or alkanol sulfonic acid; (B) a soluble metal salt of alkane sulfonic acid or alkanol sulfonic acid; and (C) at least one additive selected from—polyether derivatives of formula (I),—sulfonated or sulfated polyether derivatives of formula (II) or—any combinations thereof, wherein the groups in formulae (I) and (II) are as defined in the description and claims. The present invention also relates to a process for refining metal and a process for controlling morphology of metal deposited on cathode in electrolytic refining of the metal, which comprise using the electroplating bath according to the present invention.

$$Ar-O-(E_1)_m(E_2)_n-H \quad (I)$$

$$Ar'-O-(E_1')_m-(E_2')_n-(E_3)_o-SO_3M. \quad (II)$$

24 Claims, 3 Drawing Sheets

SULFONATE ELECTROPLATING BATH, PROCESS FOR REFINING METAL BY ELECTROLYTIC DEPOSITING AND PROCESS FOR CONTROLLING METAL MORPHOLOGY IN ELECTROLYTIC REFINING

CROSS-REFERENCE TO RELATED APPLICATIONS

This application is a National Stage Entry of PCT/EP2022/062881, filed May 12, 2022, which claims priority to Patent Application No. PCT/CN2021/094819, filed May 20, 2021, the disclosures of each of which are hereby incorporated by reference in their entirety.

FIELD OF THE INVENTION

The present invention relates to a metal sulfonate based electroplating bath, a process for refining crude metal by electrolytic depositing in the electroplating bath, and a process for controlling metal morphology in electrolytic refining.

BACKGROUND

Crude lead was commercially purified by pyro refining or electrolytic refining to provide high purity of lead and in some cases for recovery of noble metals. In recent decades, electrolytic refining of crude lead has been adopted by more countries and regions due to its advantages of less damage to environments, higher purification efficiency and noble metal recovery.

Conventionally, acidic aqueous solutions comprising lead fluoroborate or fluosilicate were widely used as electroplating bath for electrolytic refining crude lead, which however have low thermal stability and high level of volatility and will inevitably result in harmful health effects and negative impact on production equipment so that safe and efficient operation cannot be achieved. Processes for electrolytic refining other metals such as tin also has the same problem.

Recently, acidic fluorine-free aqueous solutions have been developed as substitutes of the electroplating bath comprising fluoborate or fluosilicate. For example, CN104746908A describes a process for electrolytic refining lead using an aqueous electrolytic solution comprising lead methanesulfonate and methanesulfonic acid. The electrolytic solution may also comprise one or more additives selected from animal glue, lignosulfonate, aloin and β-naphthol.

The electrolytic refining process using methanesulfonate based electroplating bath as described in CN104746908A successfully overcame the toxicity and pollution shortcomings of the fluoborate or fluosilicate based electroplating bath.

However, it was found by the inventors of the present invention that the process as described in CN104746908A could not provide desirable appearance or morphology of lead deposit on the cathode. It was observed that the lead deposit has coarse or loose surface, with burr, dendrite or scale at edges, which will prevent the application of the process on commercial scale, since the appearance or morphology defects, particular dendrite may possibly cause short circuit before obtaining sufficient amount of deposit to be harvest in the electrolytic tank.

There is still a need of fluorine-free electroplating bath suitable for electrolytic refining metal with improved appearance or morphology of the deposited metal, and thus with desirable efficiency.

SUMMARY OF THE INVENTION

It is an object of the present invention to provide a fluorine-free electroplating bath based on sulfonate, which are useful for electrolytic refining metal to obtain metal deposit on the cathode with desirable appearance or morphology.

Another object of the present invention is to provide an electrolytic refining process having improved overall process economics and being able to be conducted with flexible process conditions.

It has been found that the objects of the present invention can be achieved by an electroplating bath which comprises an additive selected from phenol and naphthol polyether derivatives and sulfated or sulfonated phenol and naphthol polyether derivatives.

Accordingly, in one aspect, the present invention provides an electroplating bath, which comprises:

(A) an alkane sulfonic acid or alkanol sulfonic acid;

(B) a soluble metal salt of alkane sulfonic acid or alkanol sulfonic acid; and (C) at least one additive selected from polyether derivatives of formula (I), $$\mathrm{Ar{-}O{-}(E_1)_m(E_2)_n{-}H} \qquad \text{(I)}$$

wherein

Ar is phenyl substituted by $C_3$-$C_{12}$-alkyl, or naphthyl which is non-substituted or substituted by $C_1$-$C_4$-alkyl, $E_1$ and $E_2$ are different from each other and selected from ethyleneoxy and propyleneoxy, m is 0 or a number in the range of 1 to 40, n is a number in the range of 1 to 40, sulfonated or sulfated polyether derivatives of formula (II), $$\mathrm{Ar'{-}O{-}(E_1')_{m'}(E_2')_{n'}(E_3)_o{-}SO_3M}, \qquad \text{(II)}$$

wherein A

Ar' is phenyl substituted by $C_3$-$C_{12}$-alkyl and optionally substituted by a group of —$SO_3M$, or naphthyl which is non-substituted or substituted by $C_1$-$C_4$-alkyl and/or a group of —$SO_3M$, $E_1'$ and $E_2'$ are different alkyleneoxy groups and selected from ethyleneoxy and propyleneoxy, $E_3$ is the alkylene moiety of $E_2$, m' is 0 or a number in the range of 1 to 40, o is 0 or 1, the sum of n'+o is a number in the range of 1 to 40, and M is an alkali metal cation or $NH_4^+$, and any combinations thereof.

In another aspect, the present invention provides a process for refining metal, which comprises electrolytic depositing the metal in the electroplating bath comprising (A) an alkane sulfonic acid or alkanol sulfonic acid; (B) a soluble metal salt of alkane sulfonic acid or alkanol sulfonic acid; and (C) at least one additive selected from the polyether derivatives, the sulfonated or sulfated polyether derivatives or any combination thereof as described herein.

In still another aspect, the present invention provides a process for controlling morphology of metal, particularly lead deposited on cathode in electrolytic refining of the metal, which comprises using the electroplating bath comprising (A) at least one soluble metal salt of alkane sulfonic acid or alkanol sulfonic acid; (B) at least one soluble alkane sulfonate or alkanolsulfonate of the metal; and (C) at least one additive selected from the polyether derivatives, the sulfonated or sulfated polyether derivatives or any combination thereof as described herein.

In a further aspect, the present invention provides use of the polyether derivatives, the sulfonated or sulfated polyether derivatives or any combinations thereof as described herein in an electroplating bath for refining metal, in particular lead and/or tin.

DETAILED DESCRIPTION OF THE INVENTION

Figure 1:
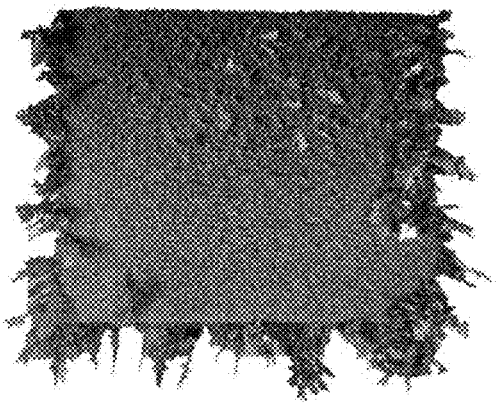
FIG. 1 shows a morphology picture of the deposited lead according to Comparative Example 1 without using any additive in the electroplating bath.

The present invention now will be described in details hereinafter. It is to be understood that the present invention may be embodied in many different ways and shall not be construed as limited to the embodiments set forth herein. Unless mentioned otherwise, all technical and scientific terms used herein have the same meaning as commonly understood by one of ordinary skill in the art to which the present invention belongs.

As used herein, the singular forms "a", "an" and "the" include plural referents unless the context clearly dictates otherwise.

As used herein, the terms "comprise", "comprising", etc. are used interchangeably with "contain", "containing", etc. and are to be interpreted in a non-limiting, open manner. That is, e.g., further components or elements may be present. The expressions "consists of" or "consists essentially of" or cognates may be embraced within "comprises" or cognates.

As used herein, the term "aqueous" means that an electroplating bath comprises a solvent comprising at least 50% water. Preferably, at least 75%, more preferably 90% of the solvent is water. It can be contemplated that the solvent of the electroplating bath consists essentially of water without any intentionally added organic solvent. Any type of water may be used, such as distilled, deionized, or tap water.

<Electroplating Bath>

In the first aspect, the present invention provides an electroplating bath comprising:

(A) an alkane sulfonic acid or alkanol sulfonic acid;

(B) a soluble metal salt of alkane sulfonic acid or alkanol sulfonic acid; and (C) at least one additive selected from polyether derivatives of formula (I),

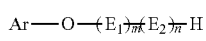

$$Ar—O—(E_1)_m(E_2)_n—H \quad (I)$$

wherein

Ar is phenyl substituted by $C_3$-$C_{12}$-alkyl, or naphthyl which is non-substituted or substituted by $C_1$-$C_4$-alkyl, $E_1$ and $E_2$ are different from each other and selected from ethyleneoxy and propyleneoxy, m is 0 or a number in the range of 1 to 40, n is a number in the range of 1 to 40, sulfonated or sulfated polyether derivatives of formula II),

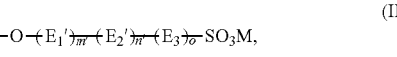

$$Ar'—O—(E_1')_{m'}(E_2')_{n'}(E_3)_o—SO_3M, \quad (II)$$

wherein

Ar' is phenyl substituted by $C_3$-$C_{12}$-alkyl and optionally substituted by a group of —$SO_3M$, or naphthyl which is non-substituted or substituted by $C_1$-$C_4$-alkyl and/or a group of —$SO_3M$, $E_1'$ and $E_2'$ are different alkyleneoxy groups and selected from ethyleneoxy and propyleneoxy, $E_3$ is the alkylene moiety of $E_2$, m' is 0 or a number in the range of 1 to 40, o is 0 or 1, the sum of n'+o is a number in the range of 1 to 40, and M is an alkali metal cation or $NH_4^+$, and any combinations thereof.

Useful alkane sulfonic acids as the component (A) may be $C_1$-$C_{12}$-alkane sulfonic acids, preferably $C_1$-$C_6$-alkane sulfonic acids. Examples of the alkane sulfonic acids include, but are not limited to methane sulfonic acid, ethane sulfonic acid, propane sulfonic acid, 2-propane sulfonic acid, butane sulfonic acid, 2-butane sulfonic acid, pentane sulfonic acid, hexane sulfonic acid, decane sulfonic acid and dodecane sulfonic acid. One alkane sulfonic acid or any mixture of two or more alkane sulfonic acids may be used in the electroplating bath according to the invention.

Useful alkanol sulfonic acids as the component (A) may be $C_2$-$C_{12}$alkanol sulfonic acids, preferably $C_2$-$C_6$-alkanol sulfonic acids i.e., hydroxy substituted $C_2$-$C_{12}$-, preferably $C_2$-$C_6$-alkane sulfonic acids. The hydroxy may be on a terminal or internal carbon of alkyl chain of the alkane sulfonic acids. Examples of useful alkanol sulfonic acids include, but are not limited to 2-hydroxyethane-1-sulfonic acid, 1-hydroxypropane-2-sulfonic acid, 2-hydroxypropane-1-sulfonic acid, 3-hydroxypropane-1-sulfonic acid, 2-hydroxybutane-1-sulfonic acid, 4-hydroxybutane-1-sulfonic acid, 2-hydroxypentane-1-sulfonic acid, 4-hydroxypentane-1-sulfonic acid, 2-hydroxyhexane-1-sulfonic acid, 2-hydroxydecane-1-sulfonic acid, 2-hydroxydodecane-1-sulfonic acid. One alkanol sulfonic acid or any mixture of two or more alkanol sulfonic acids may be used in the electroplating bath according to the invention.

The alkane sulfonic acids and alkanol sulfonic acids may be those prepared by any methods known in the art or commercially available ones without particular restrictions.

The component (A) may be comprised in the electroplating bath according to the present invention at a concentration in a range of 10 to 200 grams per liter (g/L) of the bath, particularly to 150 g/L, preferably 50 to 110 g/L.

The soluble metal salt of alkane sulfonic acid or alkanol sulfonic acid as the component (B) is a salt of the metal to be deposited via electrolysis. The metal useful for the present invention may be lead or tin, particularly lead. Accordingly, the component (B) may be a soluble alkane sulfonate or alkanolsulfonate salt of lead or tin, particularly lead.

Herein, the term "soluble metal salt" is intended to mean the metal sak may be dissolved in the electroplating bath before and during electrolysis.

The soluble metal salt of the alkane sulfonic acid or alkanol sulfonic acid may be derived from the same alkane sulfonic acid or alkanol sulfonic acid as the component (A). Particularly, the component (B) is a soluble metal salt of the same alkane sulfonic acid or alkanol sulfonic acid used as the component (A), the metal being lead or tin.

For example, the electroplating bath according to the present invention may comprise methanesulfonic acid as the component (A) and comprise lead (II) methanesulfonate as the component (B).

Soluble metal salts of alkane sulfonic acid and alkanol sulfonic acids may be prepared by any methods known in the art, for example via the reaction of an oxide of the metal with an alkane sulfonic acid or alkanol sulfonic acid as desired.

The component (B) may be comprised in the electroplating bath according to the present invention at a concentration in a range of 50 to 200 g/L of the bath, particularly 70 to 150 g/L, preferably 90 to 150 g/L, more preferably 90 to 120 g/L, calculated as the metal ions.

The electroplating bath according to the present invention comprises at least one additive selected from the polyether derivatives of formula (I), the sulfonated or sulfated polyether derivatives of formula (II) or any combinations thereof. It has been surprisingly found that the at least one additive is essential for depositing the metal with desirable appearance on the cathode when the electroplating bath is used in an electroplating or electrolytic refining process.

In some embodiments, the at least one additive (C) is preferably selected from the polyether derivatives of formula (I) wherein m is 0 or a number in the range of 2 to 35, n is a number in the range of 2 to 35, the sulfonated or sulfated polyether derivatives of formula (II) wherein m' is 0 or a number in the range of 2 to 35, o is 0 or 1 and the sum of n'+o is a number in the range of 2 to 35, or any combinations thereof.

In some embodiments, the at least one additive (C) is preferably selected from the polyether derivatives of formula (I) wherein m is 0 or a number in the range of 4 to 30 and n is a number in the range of 4 to 30, the sulfonated or sulfated polyether derivatives of formula (II) wherein m' is 0 or a number in the range of 4 to 30, o is 0 or 1 and the sum of n'+o is a number in the range of 4 to 30, or any combinations thereof.

In some particular embodiments, the at least one additive (C) is preferably selected from the polyether derivatives of formula (I) wherein m is 0 or a number in the range of 6 to 20 and n is a number in the range of 6 to 20, the sulfonated or sulfated polyether derivatives of formula (II) wherein m' is 0 or a number in the range of 6 to 20, o is 0 or land the sum of n'+o is a number in the range of 6 to 20, or any combinations thereof.

In some preferable embodiments, the at least one additive (C) is preferably selected from the polyether derivatives of formula (I) wherein m 0 or is a number in the range of 8 to 15, n is a number in the range of 8 to 15, the sulfonated or sulfated polyether derivatives of formula (II) wherein m' is 0 or a number in the range of 8 to 15, o is 0 or 1 and the sum of n'+o is a number in the range of 8 to 15, or any combinations thereof.

In some illustrative embodiments, the at least one additive (C) is selected from the polyether derivatives of formula (I)

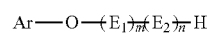

(I)

wherein

Ar is phenyl substituted by $C_3$-$C_{12}$-alkyl, or naphthyl which is non-substituted or substituted by $C_1$-$C_4$-alkyl, $E_1$ and $E_2$ are different from each other and selected from ethyleneoxy and propyleneoxy, m is 0 or a number in the range of 4 to 30, n is a number in the range of 4 to 30, sulfonated or sulfated polyether derivatives of formula II),

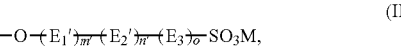

(II)

wherein

Ar' is phenyl substituted by $C_3$-$C_{12}$-alkyl and optionally substituted by a group of —$SO_3M$, or naphthyl which is non-substituted or substituted by $C_1$-$C_4$-alkyl and/or a group of —$SO_3M$, $E_1$' and $E_2$' are different alkyleneoxy groups and selected from ethyleneoxy and propyleneoxy, $E_3$ is the alkylene moiety of $E_2$, m' is 0 or a number in the range of 4 to 30, is 0 or 1, the sum of n'+o is a number in the range of 4 to 30, and M is an alkali metal cation or $NH_4^+$, and any combinations thereof.

In the embodiments as described hereinabove, it is preferred that either or both of m in formula (I) and m' in formula (II) are 0. Accordingly, the at least one additive (C) is preferably selected from the polyether derivatives of formula (I) wherein m is 0 and n is a number in the range of 4 to 30, preferably 6 to 20, more preferably 8 to 15, the sulfonated or sulfated polyether derivatives of formula (II) wherein m' is 0, o is 0 or 1 and the sum of n'+o is a number in the range of 4 to 30, preferably 6 to 20, more preferably 8 to 15, or any combinations thereof. In those embodiments, it is further preferred that $E_2$ and $E_2'$ are ethyleneoxy.

In some further illustrative embodiments, the at least one additive (C) is selected from the polyether derivatives of formula (Ia)

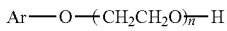

(Ia)

wherein

Ar is 4-($C_3$-$C_{12}$-alkyl)phenyl or non-substituted naphthyl, n is a number in the range of 4 to 30, sulfonated or sulfated polyether derivatives of formula (II),

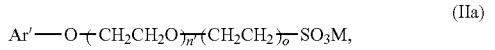

(IIa)

wherein

Ar' is 4-($C_3$-$C_{12}$-alkyl)phenyl, optionally substituted by a group of —$SO_3M$, or naphthyl which is non-substituted or substituted a group of —$SO_3M$, o is 0 or 1, the sum of n'+o is a number in the range of 4 to 30, and M is an alkali metal cation or $NH_4^+$, and any combinations thereof.

The polyether derivatives according to any of above embodiments are preferably of formula (I) or (Ia) wherein the group Ar is phenyl substituted by $C_4$-$C_{10}$-alkyl, preferably 4-($C_4$-$C_{10}$-alkyl)phenyl, or non-substituted naphthyl, preferably non-substituted β-naphthyl.

More preferably, the polyether derivatives are of formula (I) or (Ia) wherein the group Ar is non-substituted β-naphthyl.

Alternatively or additionally, the sulfonated or sulfated polyether derivatives according to any of above embodiments are preferably of formula (II) or (IIa) wherein the group Ar' is phenyl substituted by $C_4$-$C_1$-alkyl and —$SO_3M$, preferably 4-($C_4$-$C_{12}$-alkyl)phenyl having —$SO_3M$ on the ring, or naphthyl which is non-substituted or substituted by —$SO_3M$.

More preferably, the sulfonated or sulfated polyether derivatives are of formula (II) or (IIa) wherein the group Ar' is 4-($C_4$-$C_{12}$(-alkyl)phenyl having a group of —$SO_3M$ at the 2- or 3-position of the phenyl ring.

As used herein, the term "$C_3$-$C_{12}$-alkyl" and "$C_4$-$C_{10}$-alkyl" refers to linear or branched, saturated hydrocarbyl, for example n-propyl, n-butyl, n-pentyl, n-hexyl, n-heptyl, n-octyl, n-nonyl, n-decyl, n-undecyl, n-dodecyl, and isomers thereof.

Herein, the term "propyleneoxy" as described may refer to methyl substituted ethyleneoxy, for example 1-methylethyleneoxy or 2-methylethyleneoxy.

Particularly, the at least one additive (C) is selected from the polyether derivatives of formula (Ia) wherein Ar is non-substituted β-naphthyl, and n is a number in the range of 6 to 20, the sulfonated or sulfated polyether derivatives of formula (IIa) wherein Ar' is 4-($C_4$-$C_{10}$-alkyl)phenyl having a group of —$SO_3M$ at the 2- or 3-position of the phenyl ring, o is 0, n' is a number in the range of 6 to 20, and M is an alkali metal cation or $NH_4^+$, and any combinations thereof.

More particularly, the at least one additive (C) is selected from the polyether derivatives of formula (Ia) wherein Ar is non-substituted β-naphthyl, and n is a number in the range of 8 to 15, the sulfonated or sulfated polyether derivatives of formula (IIa) wherein Ar' is 4-($C_4$-$C_{10}$-alkyl)phenyl having a group of —$SO_3M$ at the 2- or 3-position of the phenyl ring, o is 0, n' is a number in the range of 8 to 15, and M is an alkali metal cation or $NH_4^+$, and any combinations thereof.

For example, the at least one additive (C) is selected from the polyether derivatives of formula (Ia) wherein Ar is non-substituted β-naphthyl, and n is 10, 11, 12 or 13;

the sulfonated or sulfated polyether derivatives of formula (IIa) wherein Ar' is 4-($C_4$-$C_{10}$-alkyl)phenyl having a group of —$SO_3M$ at the 2- or 3-position of the phenyl ring, o is 0, n' is 9, 10, 11 or 12, and M is an alkali metal cation or $NH_4^+$, and any combinations thereof.

Herein, suitable alkali metal cation as M in formulae (II) and (IIa) may particularly be sodium cation ($Na^+$) or potassium cation ($K^+$).

The polyether derivatives of formulae (I) and (Ia) may be prepared by any methods known in the art, for example via oxyalkylation of the starting substituted phenol or the starting naphthol with an alkylene oxide such as ethylene oxide or propylene oxide or with both in sequence. The methods for preparation of the sulfonated or sulfated polyether derivatives of formula (II) and (IIa) are also known in the art, for example by sulfonation of the polyether derivatives of formula (I) and (Ia), and then neutralization.

The polyether derivatives and the sulfonated or sulfated polyether derivatives as described herein may also be commercially available, for example from BASF.

The at least one additive (C) each may be comprised in the electroplating bath according to the present invention at a concentration in the range of 0.5 to 5.0 g/L of the bath, particularly 0.5 to 3.0 g/L.

In some embodiments, the electroplating bath according to the present invention may comprise a combination of at least one polyether derivative and at least one sulfonated or sulfated polyether derivative as described herein generally and preferably as the component (C). When such a combination is used, the additives as the component (C) may be comprised in the electroplating bath at a total concentration in the range of 1.0 to 5.0 g/L of the bath, particularly 2.0 to 5.0 g/L.

The electroplating bath according to the present invention may further comprise an additional additive (D) selected from animal glue such as bone glue, lignosulfonate, aloin and β-naphthol, particularly lignosulfonate, for example calcium lignosulfonate. The additional additive may be comprised in the electroplating bath at a concentration of in the range 0.1 to 2.0 g/L of the bath.

In some illustrative embodiments, the present invention provides an electroplating bath, which comprises (A) a $C_1$-$C_6$-alkane sulfonic acid;

(B) a soluble metal salt of the $C_1$-$C_6$-alkane sulfonic acid, the metal being selected from lead and tin, particularly lead;

(C) at least one additive selected from the polyether derivatives of formula (Ia) wherein Ar is non-substituted β-naphthyl and n is a number in the range of 6 to 20, the sulfonated or sulfated polyether derivatives of formula (IIa) wherein Ar' is 4-($C_4$-$C_{10}$-alkyl)phenyl having a group of —$SO_3M$ at the 2- or 3-position of the phenyl ring, o is 0, n' is a number in the range of 6 to 20 and M is an alkali metal cation or $NH_4^+$, and any combinations thereof, and (D) optionally, an additional additive selected from animal glue such as bone glue, lignosulfonate, aloin and β-naphthol.

In some further illustrative embodiments, the present invention provides an electroplating bath, which comprises (A) a $C_1$-$C_6$-alkane sulfonic acid;

(B) a soluble metal salt of the $C_1$-$C_6$-alkane sulfonic acid, the metal being lead;

(C) at least one additive selected from the polyether derivatives of formula (Ia) wherein Ar is non-substituted β-naphthyl and n is a number in the range of 8 to 15, the sulfonated or sulfated polyether derivatives of formula (IIa) wherein Ar' is 4-($C_4$-$C_1$-alkyl)phenyl having a group of —$SO_3M$ at the 2- or 3-position of the phenyl ring, o is 0, n' is a number in the range of 8 to 15 and M is an alkali metal cation or $NH_4^+$, and any combinations thereof, and (D) optionally, an additional additive selected from animal glue such as bone glue, lignosulfonate, aloin and β-naphthol.

In some preferable illustrative embodiments, the present invention provides an electroplating bath, which comprises (A) methanesulfonic acid;

(B) lead methanesulfonate;

(C) at least one additive selected from the polyether derivatives of formula (Ia) wherein Ar is non-substituted β-naphthyl and n is a number in the range of 8 to 15, the sulfonated or sulfated polyether derivatives of formula (IIa) wherein Ar' is 4-($C_4$-$C_{10}$-alkyl)phenyl having a group of —$SO_3M$ at the 2- or 3-position of the phenyl ring, o is 0, n' is a number in the range of 8 to 15 and M is an alkali metal cation or $NH_4^+$, and any combinations thereof, and (D) optionally, an additional additive selected from animal glue such as bone glue, lignosulfonate, aloin and β-naphthol.

In more preferable illustrative embodiments, the present invention provides an electroplating bath, which comprises (A) methanesulfonic acid;

(B) lead methanesulfonate;

(C) at least one additive selected from the polyether derivatives of formula (Ia) wherein Ar is non-substituted β-naphthyl and n is 10, 11, 12 or 13, the sulfonated or sulfated polyether derivatives of formula (IIa) wherein Ar' is 4-($C_4$-$C_{10}$-alkyl)phenyl having a group of —$SO_3M$ at the 2- or 3-position of the phenyl ring, o is 0, n' is 9, 10, 11 or 12, and M is an alkali metal cation or $NH_4^+$ or $NH_4^+$, and any combinations thereof, and (D) optionally, an additional additive selected from animal glue such as bone glue, lignosulfonate, aloin and β-naphthol.

In those illustrative embodiments, the components are comprised in the electroplating bath according to the present invention at respective concentrations as described generally or preferably hereinabove for each component.

<Electrolytic Refining Process>

In the second aspect, the present invention also provides a process for refining metal, which comprises electrolytic depositing the metal in an electroplating bath as described in the first aspect of the invention. Any description and preferences described hereinabove for the electroplating bath are applicable here by reference.

The process for refining metal according to the present invention may be carried out in accordance with any known electroplating methods without particular restrictions.

For example, the process for refining metal according to the present invention may comprise a) placing an anode made of the metal to be refined and a cathode into the electroplating bath, and b) applying a voltage between the anode and the cathode for a time sufficient to deposit a layer of the metal onto the cathode.

The metal to be refined, i.e., crude metal, may have a purity of at least 85%, for example 90 to 98.5%, There is no particular restriction to the material of cathode. The cathode useful for the electrolytic depositing may be made of, for example, stainless steel, titanium, pure metal same as the metal to be refined. For example, the cathode may be made of pure lead in the case of that crude lead is refined by the process according to the present invention.

The electrolytic depositing may be carried out at an ambient temperature or an elevated temperature, for example in the range of 20° C. to 70° C., preferably 30° C. to 60° C.

The current density useful for the electrolytic depositing may be in the range of 80 to 500 A/$m^2$, preferably 100 to 300 A/$m^2$, more preferably 140 to 260 A/$m^2$.

The electroplating bath may be pumped at a flow rate of 40 to 80 liters per minute (L/min) during the operation of the process. The electroplating bath may be pumped from a reservoir into the electrolytic tank from the top and exit from the bottom of the tank, or may be pumped into the electrolytic tank from the bottom and exit from the top of the tank.

The anode and the cathode may be arranged at a distance of 1 cm to 10 cm, preferably 3 cm to 6 cm, for example 3 cm to 5.5 cm or 3 cm to 5 cm.

The electrolytic depositing may generally be carried out for a period of 2 to 7 days, for example 3, 4, 5, 6, 7 days or even longer.

It can be contemplated that multiple electroplating cells will be used if the process for refining metal is carried out on commercial scale. The electroplating cells may be connected electrically in parallel.

By using the electroplating bath according to the present invention, a high current efficiency of 98% or higher is obtained, a low bath voltage of 0.4V or lower is required, and thus the energy consumption is low.

In the third aspect, the present invention further provides a process for controlling morphology of metal, particularly lead deposited on cathode in electrolytic refining of the metal, which comprises using the electroplating bath as described in the first aspect of the invention. Any description and preferences described hereinabove for the electroplating bath are applicable here by reference.

The process for controlling morphology of metal according to the present invention may be carried out under conditions as described in the second aspect of the invention. Any description and preferences described hereinabove for the electrolytic refining process are applicable here by reference.

In the fourth aspect, the present invention provides use of the polyether derivatives, the sulfonated or sulfated polyether derivatives or any combinations thereof as described herein in an electroplating bath for refining metal.

EXAMPLES

Description of Measurements In Examples

Scanning electron microscopy (SEM): TESCAN MIRA3 LMU scanning electron microscope was used to characterize the appearance and morphology of the cathode deposit.

Current efficiency (η) was calculated in accordance with the following equation: □

$$\eta = \frac{m}{q \times I \times t} \times 100\%$$

in which

η represents current efficiency, expressed in %;

m represents mass of lead deposited per cell over a period of t, expressed in g;

l represents electric current intensity, expressed in A;

t represents period of electroplating, expressed in h; and q represents electrochemical equivalent of lead, 3.867 g/(A·h).

Electrical energy consumption (W) was calculated in accordance with the following equation:

$$W = \frac{U \times 1000}{\eta \times q} \times 100\%$$

W represents energy consumption, expressed in kWh/t;

η represents current efficiency, expressed in %; and

U represents average bath voltage, expressed in V.

Comparative Example 1

Yellow PbO was dissolved in an aqueous solution of diluent methanesulfonic acid to provide a solution containing 110 g/L of lead ions and 70 g/L of free methanesulfonic acid as the electroplating bath. The solution kept at 45° C. was pumped into an electrolytic tank from the bottom and exited from the top at a flow rate of 55 L/min. A pre-polished crude lead plate having a composition of 95.3% Pb, 0.04% Cu, 0.04% As, 1.01% Sb, 0.03% Sn, 0.02% Bi and 0.56% Ag and remaining impurity was used as the anode and a pre-polished lead starting sheet was used as the cathode, which were arranged at a distance of 5 cm. The electroplating was conducted at 45° C. by applying a direct current with the current density of 180 A/m$^2$ for 2 hours.

It was observed that the deposited lead had a loose surface, poor metallic luster and dendrite along the edge of the lead deposit, as shown in FIG. 1. The bath voltage is 0.37 V, as determined by Longway power supply LW-305KDS, the current efficiency (η) is 97.4% and the electrical energy consumption (W) is 95.4 kw·h/tPb.

Comparative Example 2

The process was carried out in the same manner as the comparative Example 1 except that 1 g/L of bone glue (available from WoLong Chemicals, China) as additive was added to the electroplating bath, and the electroplating was conducted for 3 days.

Figure 2A:
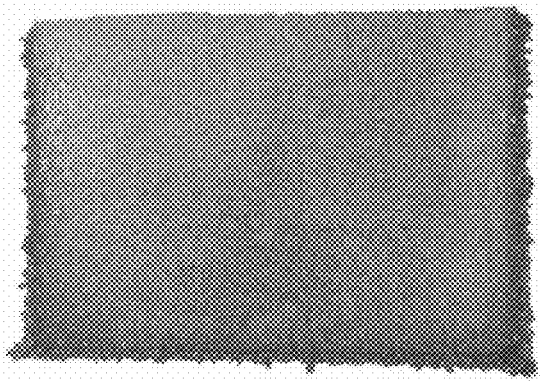
FIGS. 2A and 2B show morphology picture and SEM image of the deposited lead according to Comparative Example 2 using bone glue as additive in the electroplating bath.
Figure 2B:
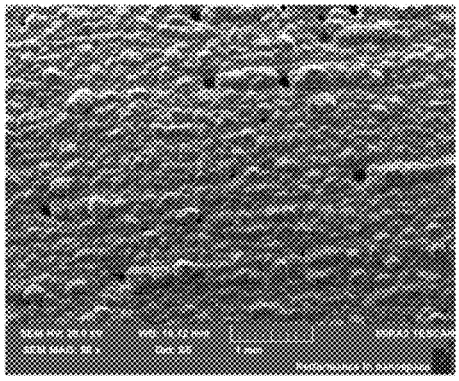

It was observed that there were pores on the surface of deposited lead, although no substantive dendrite was produced, as shown in FIGS. 2A and 2B (enlarged portion). The bath voltage is 0.35 V, the current efficiency is only 82.6% and the electrical energy consumption is 107.9 kwh/tPb.

Comparative Example 3

The process was carried out in the same manner as the comparative Example 1 except that 1 g/L of calcium lignosulfonate (available from Shanghai Aladdin Bio-Chem Technology Co., Ltd., China) as additive was added to the electroplating bath.

Figure 3:
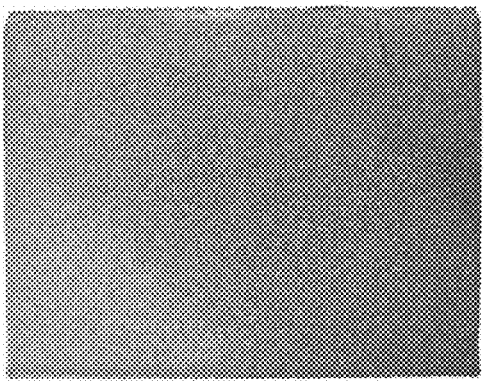
FIG. 3 shows a morphology picture of the deposited lead according to Comparative Example 3 using calcium lignosulfonate as additive in the electroplating bath.

It was observed that the deposited lead had a loose surface, as shown in FIG. 3. The bath voltage is 0.41 V, the current efficiency is 97.9% and the electrical energy consumption is 110.4 kw·h/tPb.

Comparative Example 4

The process was carried out in the same manner as the comparative Example 1 except that 0.2 g/L of bone glue and 2 g/L of calcium lignosulfonate as additives were added to the electroplating bath.

Figure 4:
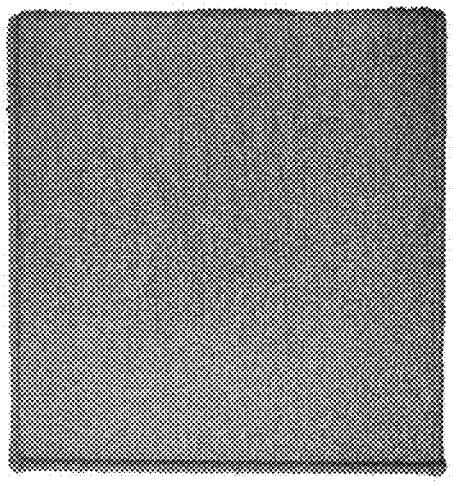
FIG. 4 shows a morphology picture of the deposited lead according to Comparative Example 4 using bone glue and calcium lignosulfonate as additives in the electroplating bath.

It was observed that the deposited lead had poor metallic luster, as shown in FIG. 4. The bath voltage is 0.47 V, the current efficiency is 99.2% and the electrical energy consumption is 127.8 kw·h/tPb.

Comparative Example 5

Yellow PbO was dissolved in an aqueous solution of diluent methanesulfonic acid to provide a solution containing 100 g/L of lead ions and 60 g/L of free methanesulfonic acid as the electroplating bath, to which 0.3 g/L of β-naphthol was added as additive. The solution kept at 45° C. was pumped into an electrolytic tank from the bottom and exited from the top at a flow rate of 55 L/min. A pre-polished crude lead plate having a composition of 95.3% Pb, 0.04% Cu, 0.04% As, 1.01% Sb, 0.03% Sn, 0.02% Bi, 0.56% Ag and remaining impurity was used as the anode and a pre-polished pre-polished lead starting sheet was used as the cathode, which were arranged at a distance of 4 cm. The electroplating was conducted at 45° C. by applying a direct current with the current density of 180 A/m$^2$ for 8 hours.

Figure 5A:
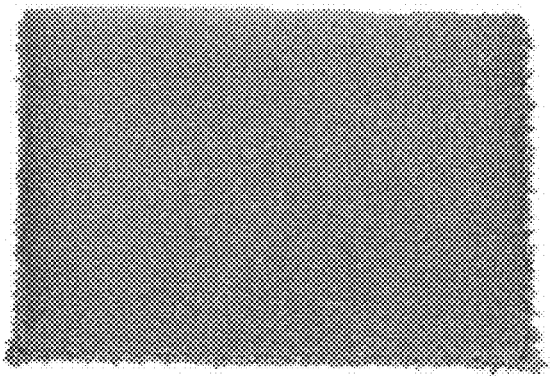
FIGS. 5A and 5B show morphology picture and SEM image of the deposited lead according to Comparative Example 5 using β-naphthol as additive in the electroplating bath.
Figure 5B:
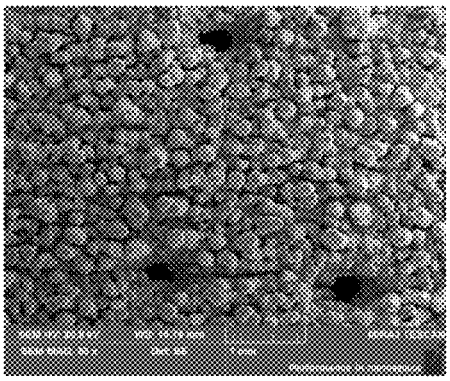

It was observed that the deposited lead has a loose surface, poor metallic luster, as shown in FIGS. 5A and 5B (enlarged portion). The bath voltage is 0.37 V, the current efficiency (r) is 97.6% and the electrical energy consumption (W) is 97.9 kw·h/tPb.

Example 1

Yellow PbO was dissolved in an aqueous solution of diluent methanesulfonic acid to provide a solution containing 100 g/L of lead ions and 80 g/L of free methyl sulfonic acid as the electroplating bath, to which 2 g/L of β-naphthol ethoxylate (12 EO) and 0.5 g/L of calcium lignosulfonate were added as additives. The solution kept at 50° C. was pumped into an electrolytic tank from the bottom and exited from the top at a flow rate of 40 L/min. A pre-polished crude lead plate having a composition of 96% Pb, 0.06% Cu, 0.05% As, 1.09% Sb, 0.01% Sn, 0.08% Bi, 0.54% Ag and remaining impurity was used as the anode and a pre-polished titanium plate was used as the cathode, which were arranged at a distance of 5 cm. The electroplating was conducted at 50° C. by applying a direct current with the current density of 190 A/m$^2$ for 3 days.

Figure 6A:
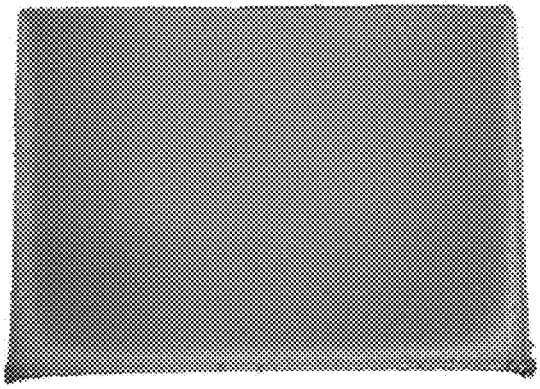
FIGS. 6A and 6B show morphology picture and SEM image of the deposited lead according to Inventive Example 1 using β-naphthol ethoxylate (12 EO) and calcium lignosulfonate as additives in the electroplating bath.
Figure 6B:
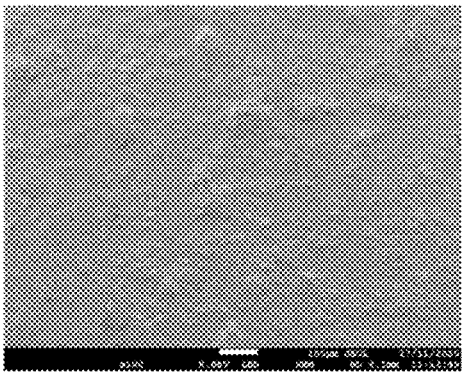

It was observed that the deposited lead had a smooth and dense surface, and no dendrite or burr along the edge of the lead deposit, as shown in FIGS. 6A and 6B (enlarged portion). The bath voltage is 0.41 V, the current efficiency is 99.9% and the electrical energy consumption is 106.4 kw·h/tPb.

Example 2

Yellow PbO was dissolved in an aqueous solution of diluent methanesulfonic acid to provide a solution containing 100 g/L of lead ions and 80 g/L of free methanesulfonic acid as the electroplating bath, to which 0.5 g/L of β-naphthol ethoxylate (12 EO) [commercially available from BASF] and 3 g/L of sulfonate substituted p-nonyl phenol ethoxylate sulfate (10 EO, sodium salt) [commercially available from BASF] were added as additives. The solution kept at 40° C. was pumped into an electrolytic tank from the bottom and exited from the top at a flow rate of 50 L/min. A pre-polished crude lead plate having a composition of 94.5% Pb, 0.05% Cu, 0.80% As, 1.09% Sb, 0.01% Sn, 0.1% Bi, 0.45% Ag and remaining impurity was used as the anode and a pre-polished lead starting sheet was used as the cathode, which were arranged at a distance of 4 cm. The electroplating was conducted at 40° C. by applying a direct current with the current density of 180 A/m$^2$ for 3 days.

Figure 7A:
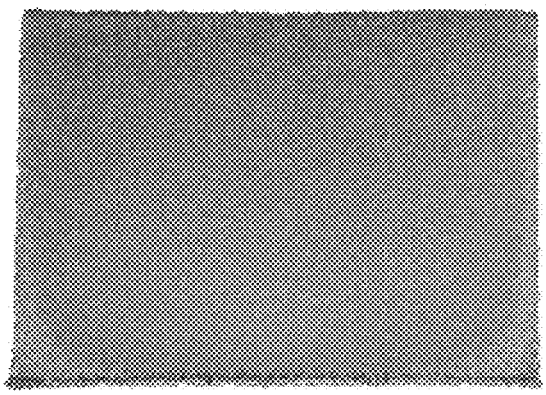
FIGS. 7A and 7B show morphology picture and SEM image of the deposited lead according to Inventive Example 2 using β-naphthol ethoxylate (12 EO) and sulfonate substituted p-nonyl phenol ethoxylate sulfate (10 EO, sodium salt) as additives in the electroplating bath.
Figure 7B:
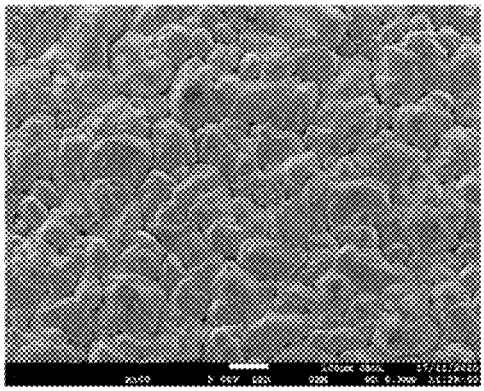

It was observed that the deposited lead had a smooth and dense surface, and no dendrite or burr along the edge of the lead deposit, as shown in FIGS. 7A and 7B (enlarged portion). The bath voltage is 0.31 V, the current efficiency is 98.2% and the electrical energy consumption is 81.6 kw·h/tPb.

Example 3

Yellow PbO was dissolved in an aqueous solution of diluent methanesulfonic acid to provide a solution containing 110 g/L of lead ions and 60 g/L of free methanesulfonic acid as the electroplating bath, to which 0.8 g/L of calcium lignosulfonate and 0.5 g/L of sulfonate substituted p-nonyl phenol ethoxylate sulfate (10 EO, sodium salt) [commercially available from BASF] were added as additives. The solution kept at 35° C. was pumped into an electrolytic tank from the bottom and exited from the top at a flow rate of 60 L/min. A pre-polished crude lead plate having a composition of 98.2% Pb, 0.02% Cu, 0.02% As, 0.3% Sb, 0.03% Sn, 0.01% Bi, 0.34% Ag and remaining impurity was used as the anode and a pre-polished lead starting sheet was used as the cathode, which were arranged at a distance of 4.5 cm. The electroplating was conducted at 35° C. by applying a direct current with the current density of 230 A/m$^2$ for 3 days.

Figure 8A:
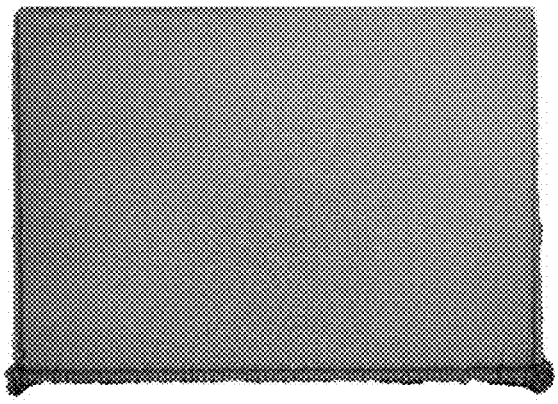
FIGS. 8A and 8B show morphology picture and SEM image of the deposited lead according to Inventive Example 3 using calcium lignosulfonate and sulfonate substituted p-nonyl phenol ethoxylate sulfate (10 EO, sodium salt) as additives in the electroplating bath.
Figure 8B:
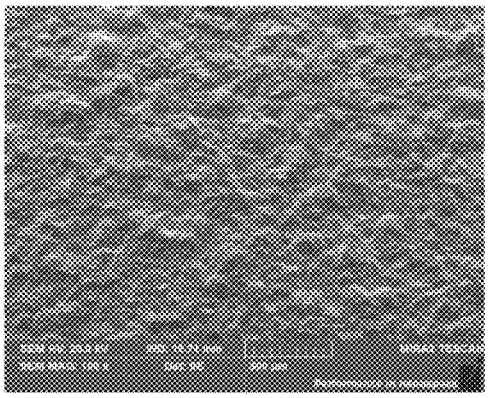

It was observed that the deposited lead had a smooth and dense surface, and no dendrite or burr along the edge of the lead deposit, as shown in FIGS. 8A and 8B (enlarged portion). The bath voltage is 0.40 V, the current efficiency is 98.5% and the electrical energy consumption is 104.9 kw·h/tPb.

Example 4

Yellow PbO was dissolved in an aqueous solution of diluent methanesulfonic acid to provide a solution containing 120 g/L of lead ions and 100 g/L of free methanesulfonic acid as the electroplating bath, to which 0.5 g/L of calcium lignosulfonate, 1 g/L of sulfonate substituted p-nonyl phenol ethoxylate sulfate (10 EO, sodium salt) [commercially available from BASF] and 1 g/L of β-naphthol ethoxylate (12 EO) [commercially available from BASF] were added as additives. The solution kept at 40° C. was pumped into an electrolytic tank from the bottom and exited from the top at a flow rate of 60 L/min. A pre-polished crude lead plate having a composition of 97.5% Pb, 0.04% Cu, 0.04% As, 0.5% Sb, 0.03% Sn, 0.02% Bi, 0.31% Ag and remaining impurity was used as the anode and a pre-polished lead starting sheet was used as the cathode, which were arranged at a distance of 5 cm. The electroplating was conducted at 40° C. by applying a direct current with the current density of 200 A/m$^2$ for 3 days.

Figure 9A:
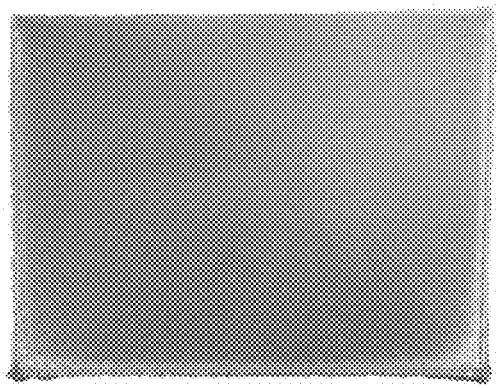
FIGS. 9A and 9B show morphology picture and SEM image of the deposited lead according to Inventive Example 4 using calcium lignosulfonate, sulfonate substituted p-nonyl phenol ethoxylate sulfate (10 EO, sodium salt) and β-naphthol ethoxylate (12 EO) as additives in the electroplating bath.
Figure 9B:
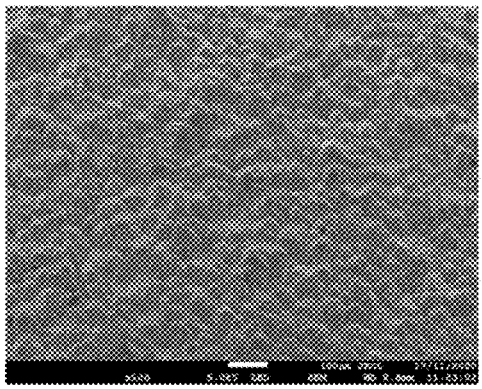

It was observed that the deposited lead had a smooth and dense surface, and no dendrite or burr along the edge of the lead deposit, as shown in FIGS. 9A and 9B (enlarged portion). The bath voltage is 0.09 V, the current efficiency is 98.8% and the electrical energy consumption is 76.05 kw·h/tPb.

Example 5

Yellow PbO was dissolved in an aqueous solution of diluent methanesulfonic acid to provide a solution containing 110 g/L of lead ions and 70 g/L of free methanesulfonic acid as the electroplating bath, to which 0.5 g/L of calcium lignosulfonate and 1 g/L of β-naphthol ethoxylate (12 EO) [commercially available from BASF] were added as additives. The solution kept at 45° C. was pumped into an electrolytic tank from the bottom and exited from the top at a flow rate of 55 L/min. A pre-polished crude lead plate having a composition of 95.3% Pb, 0.04% Cu, 0.04% As, 1.01% Sb, 0.03% Sn, 0.02% Bi and 0.56% Ag was used as the anode and a pre-polished lead starting sheet was used as the cathode, which were arranged at a distance of 5 cm. The electroplating was conducted at 45° C. by applying a direct current with the current density of 180 A/m$^2$ for 3 days.

Figure 10A:
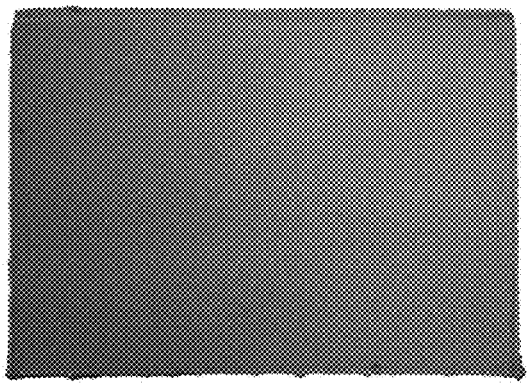
FIGS. 10A and 10B show morphology picture and SEM image of the deposited lead according to Inventive Example 3 using calcium lignosulfonate and β-naphthol ethoxylate (12 EO) as additives in the electroplating bath.
Figure 10B:
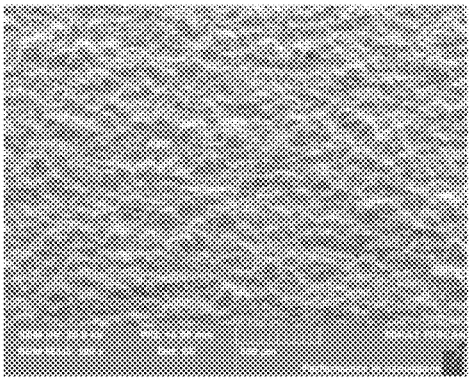

It was observed that the deposited lead had a smooth and dense surface, and no dendrite or burr along the edge of the lead deposit, as shown in FIGS. 10A and 10B (enlarged portion). The bath voltage is 0.35 V, the current efficiency is 98.8% and the energy consumption is 94.7 kw·h/tPb.

The invention claimed is:

1. An electroplating bath, comprising (A) an alkane sulfonic acid or alkanol sulfonic acid;

(B) a soluble metal salt of alkane sulfonic acid or alkanol sulfonic acid; and (C) at least one polyether derivative of formula (I), $$Ar—O—(E_1)_m(E_2)_n—H \quad (I)$$

wherein

Ar is phenyl substituted by $C_3$-$C_{12}$-alkyl, or naphthyl which is non-substituted or substituted by $C_1$-$C_4$-alkyl, $E_1$ and $E_2$ are different from each other and selected from ethyleneoxy and propyleneoxy, m is 0 or a number in the range of 1 to 40, n is a number in the range of 1 to 40, and at least one sulfonated or sulfated polyether derivative of formula (II), $$Ar'—O—(E_1')_{m'}(E_2')_{n'}(E_3)_o—SO_3M, \quad (II)$$

wherein

Ar' is phenyl substituted by $C_3$-$C_{12}$-alkyl and optionally substituted by a group of —$SO_3M$, or naphthyl which is non-substituted or substituted by $C_1$-$C_4$-alkyl and/or a group of —$SO_3M$, $E_1'$ and $E_2'$ are different alkyleneoxy groups and selected from ethyleneoxy and propyleneoxy, $E_3$ is the alkylene moiety of $E_2$, m' is 0 or a number in the range of 1 to 40, o is 0 or 1, the sum of n'+o is a number in the range of 1 to 40, and M is an alkali metal cation or $NH_4^+$.

2. The electroplating bath according to claim 1, wherein in formula (I), m is 0 or a number in the range of 2 to 35, and in formula (II), m' is 0 or a number in the range of 2 to 35, o is 0 or 1, and n'+o is a number in the range of 2 to 35.

3. The electroplating bath according to claim 2, wherein:

in formula (I),

Ar is phenyl substituted by $C_3$-$C_{12}$-alkyl, or naphthyl which is non-substituted or substituted by $C_1$-$C_4$-alkyl, $E_1$ and $E_2$ are different from each other and selected from ethyleneoxy and propyleneoxy, m is 0 or a number in the range of 4 to 30, n is a number in the range of 4 to 30, and/or in formula (II), Ar' is phenyl substituted by $C_3$-$C_{12}$-alkyl and optionally substituted by a group of —$SO_3M$, or naphthyl which is non-substituted or substituted by $C_1$-$C_4$-alkyl and/or a group of —$SO_3M$, $E_1'$ and $E_2'$ are different alkyleneoxy groups and selected from ethyleneoxy and propyleneoxy, $E_3$ is the alkylene moiety of $E_2$, m' is 0 or a number in the range of 4 to 30, o is 0 or 1, the sum of n'+o is a number in the range of 4 to 30, and M is an alkali metal cation or $NH_4^+$.

4. The electroplating bath according to claim 3, wherein the polyether derivatives of formula (I) comprise a polyether derivative of formula of (Ia)

$$Ar—O—(CH_2CH_2O)_n—H \quad (Ia)$$

wherein

Ar is 4-($C_3$-$C_{12}$-alkyl)phenyl or non-substituted naphthyl, n is a number in the range of 4 to 30, and/or the sulfonated or sulfated polyether derivatives of formula (II) comprise a sulfonated or sulfated polyether derivative of formula (IIa)

$$Ar'—O—(CH_2CH_2O)_{n'}(CH_2CH_2)_o—SO_3M, \quad (IIa)$$

wherein

Ar' is 4-($C_3$-C-$_{12}$-alkyl)phenyl, optionally substituted by a group of —$SO_3M$, or naphthyl which is non-substituted or substituted a group of —$SO_3M$, o is 0 or 1, the sum of n'+o is a number in the range of 4 to 30, and M is an alkali metal cation or $NH_4^+$.

5. The electroplating bath according to claim 4, wherein:

in formula (Ia), wherein Ar is non-substituted β-naphthyl, n is a number in the range of 6 to 20, and/or in formula (IIa), Ar' is 4-($C_4$-$C_{10}$-alkyl)phenyl having a group of —$SO_3M$ at the 2- or 3-position of the phenyl ring, o is 0, n' is a number in the range of 6 to 20, and M is an alkali metal cation or $NH_4^+$.

6. The electroplating bath according to claim 5, wherein:

in formula (Ia), Ar is non-substituted β-naphthyl, and n is a number in the range of 8 to 15, and/or in formula (IIa), Ar' is 4-($C_4$-$C_{10}$-alkyl)phenyl having a group of —$SO_3M$ at the 2- or 3-position of the phenyl ring, o is 0, n' is a number in the range of 8 to 15, and M is an alkali metal cation or $NH_4^+$.

7. The electroplating bath according to claim 6, wherein:

in formula (Ia), Ar is non-substituted β-naphthyl, n is 10, 11, 12 or 13; and/or in formula (IIa), Ar' is 4-($C_4$-$C_{10}$-alkyl)phenyl having a group of —$SO_3M$ at the 2- or 3-position of the phenyl ring, o is 0, n' is 9, 10, 11 or 12, and M is an alkali metal cation or $NH_4^+$.

8. The electroplating bath according to claim 1, wherein: in formula (I), m is 0 and n is a number in the range of 4 to 30, and/or in formula (II), m' is 0, o is 0 or 1 and the sum of n'+o is a number in the range of 4 to 30.

9. The electroplating bath according to claim 1, wherein $E_2$ and $E_2'$ are ethyleneoxy.

10. The electroplating bath according to claim 1, wherein Ar is phenyl substituted by $C_4$-$C_{10}$-alkyl, or non-substituted naphthyl.

11. The electroplating bath according to claim 10, wherein Ar is non-substituted β-naphthyl.

12. The electroplating bath according to claim 1, wherein Ar' is phenyl substituted by $C_4$-$C_{10}$-alkyl and —$SO_3M$, or naphthyl which is non-substituted or substituted by —$SO_3M$.

13. The electroplating bath according to claim 12, wherein Ar' is 4-($C_4$-$C_{10}$-alkyl)phenyl having a group of —$SO_3M$ at the 2- or 3-position of the phenyl ring.

14. The electroplating bath according to claim 1, wherein M is $Na^+$ or $K^+$.

15. The electroplating bath according to claim 1, wherein the alkane sulfonic acid (A) is selected from $C_1$-$C_{12}$-alkane sulfonic acids.

16. The electroplating bath according to claim 1, wherein the alkanol sulfonic acid (A) is selected from $C_2$-$C_{12}$-alkanol sulfonic acids.

17. The electroplating bath according to claim 1, wherein the soluble metal salt (B) is at least one soluble metal salt of the same alkane sulfonic acid or alkanol sulfonic acid as the component (A).

18. The electroplating bath according to claim 1, wherein the metal of the soluble metal salt (B) is selected from lead and tin.

19. The electroplating bath according to claim 1, wherein the at least one additive each is comprised in the electroplating bath at a concentration in the range of 0.5 to 5.0 g/L of the bath.

20. The electroplating bath according to claim 1, which comprises an additional additive (D) selected from animal glue, lignosulfonate, aloin and β-naphthol.

21. The electroplating bath according to claim 20, which comprises the additional additive at a concentration in the range of 0.1 to 2.0 g/L of the bath.

22. A process for refining metal, comprising electrolytic depositing the metal in an electroplating bath according to claim 1.

23. The process according to claim 22, further comprising a) placing an anode made of the metal to be refined and a cathode into the electroplating bath, and b) applying a voltage between the anode and the cathode for a time sufficient to deposit a layer of the metal onto the cathode.

24. The process according to claim 22, wherein the metal is selected from lead and tin.

* * * * *